US010259698B2

(12) United States Patent
Krulitsch et al.

(10) Patent No.: US 10,259,698 B2
(45) Date of Patent: Apr. 16, 2019

(54) FILLING DEVICE

(71) Applicant: KHS GmbH, Dortmund (DE)

(72) Inventors: Dieter-Rudolf Krulitsch, Bad Kreuznach (DE); Max Stolz, Langenlonsheim (DE); Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 69 days.

(21) Appl. No.: 15/326,314

(22) PCT Filed: Jun. 26, 2015

(86) PCT No.: PCT/EP2015/064481

§ 371 (c)(1),
(2) Date: Jan. 13, 2017

(87) PCT Pub. No.: WO2016/008695

PCT Pub. Date: Jan. 21, 2016

(65) Prior Publication Data

US 2017/0197814 A1 Jul. 13, 2017

(30) Foreign Application Priority Data

Jul. 14, 2014 (DE) ..... 10 2014 109 809

(51) Int. Cl.
*B67C 3/28* (2006.01)
*B67C 3/26* (2006.01)
*B67C 3/22* (2006.01)

(52) U.S. Cl.
CPC ..... *B67C 3/281* (2013.01); *B67C 3/26* (2013.01); *B67C 3/28* (2013.01); *B67C 2003/228* (2013.01); *B67C 2003/268* (2013.01)

(58) Field of Classification Search
CPC .. B67C 3/26; B67C 3/28; B67C 3/281; B67C 2003/268; B67C 2003/228
See application file for complete search history.

(56) References Cited

U.S. PATENT DOCUMENTS 4,270,585 A * 6/1981 Mette ..... B67C 3/12 141/37
4,319,613 A * 3/1982 Mette ..... B67C 3/2628 141/39
4,787,428 A * 11/1988 Bacroix ..... B67C 3/26 137/113
5,190,084 A * 3/1993 Diehl ..... B67C 3/26 141/286

(Continued)

FOREIGN PATENT DOCUMENTS

DE 9416912 U1 11/1995
DE 696 07 436 T2 11/2000

(Continued)

*Primary Examiner* — Nicolas A Arnett
(74) *Attorney, Agent, or Firm* — Occhiuti & Rohlicek LLP

(57) ABSTRACT

A filling device includes a product space that ends in a filling valve with first and second valve elements disposed in a region thereof and moved by an actuator, a sealing face, a valve stem, a valve housing having a reduced-diameter edge, and a profiled plastic sleeve that runs over the reduced-diameter edge. One of the valve elements has a plastic lining. A valve stem forms one of the valve elements and the valve housing forms the other.

19 Claims, 3 Drawing Sheets

(56) References Cited

U.S. PATENT DOCUMENTS

| | | | | |
|---|---|---|---|---|
| 7,350,546 | B2 * | 4/2008 | Stavrakis | B67C 3/26 141/386 |
| 7,661,449 | B2 * | 2/2010 | Stavrakis | B67C 3/26 141/302 |
| 7,921,886 | B2 * | 4/2011 | Stavrakis | B67C 3/28 141/302 |
| 8,028,725 | B2 * | 10/2011 | Stavrakis | B67C 3/28 141/47 |
| 9,302,894 | B2 * | 4/2016 | Poeschl | B67C 3/02 |
| 2005/0001184 | A1 * | 1/2005 | Zanga | B65B 39/004 251/63.5 |
| 2005/0098229 | A1 * | 5/2005 | Stavrakis | B67C 3/26 141/144 |
| 2005/0098230 | A1 * | 5/2005 | Stavrakis | B67C 3/26 141/144 |
| 2010/0140523 | A1 * | 6/2010 | Stavrakis | B67C 3/26 251/324 |
| 2010/0140525 | A1 * | 6/2010 | Stavrakis | B67C 3/26 251/332 |

FOREIGN PATENT DOCUMENTS

| | | | |
|---|---|---|---|
| DE | 2010 032 398 | A1 | 2/2012 |
| DE | 2014 109809 | A1 | 1/2016 |
| DE | 2014 109809 | B4 | 4/2016 |
| EP | 1310454 | A1 | 5/2003 |
| EP | 2008 138418 | A1 | 3/2008 |
| GB | 1280814 | A | 7/1972 |
| IT | 2011 067794 | A1 | 12/2009 |
| WO | 99/39978 | A1 | 8/1999 |

* cited by examiner

FILLING DEVICE

RELATED APPLICATIONS

This is the national stage under 35 USC 371 of international application PCT/EP2015/064481, filed on Jun. 26, 2015, which claims the benefit of the Jul. 14, 2014 priority date of German application DE 102014109809.9, the contents of which are herein incorporated by reference.

FIELD OF INVENTION

The present invention relates to a filling device for filling liquid-containing products into containers, in particular bottles.

BACKGROUND

A typical filling device has a product space that opens into a filling valve. A typical filling valve has an actuator that moves first and second valve elements relative to each other. These valve elements bear against each other in the region of a sealing face when the valve is closed. Otherwise, they are spaced apart.

In some embodiments, a cylindrical valve housing forms the first valve element, while a thickened valve stem forms the second valve element. This second valve element typically has an O-ring seal in the region of its sealing face.

Even when designed as prescribed, such an O-ring seal exhibits play between the edges of the O-ring groove and the O-ring itself. In particular, as the valve opens and closes, contact pressure against the valve's housing tends to deform the O-ring seal slightly. As a result, product can accumulate between the O-ring groove and the O-ring seal. This can be a problem, particularly when the filling product includes solid constituents.

SUMMARY

An object of the present invention is to provide a filling device that is easy to clean and that offers a high standard of product hygiene.

In the generic filling device described above, the invention is achieved by having at least one of the two valve elements comprise a plastic lining towards the product space. This plastic lining forms at least a portion of the wall of the product space in the region of the filling valve.

The plastic lining offers many advantages. For example, it is not necessary to carry out surface machining of the valve element to optimize flow. The plastic lining can be flow-optimized much more easily. Moreover, the plastic lining, in collaboration with a face of the other valve element, may optionally form the sealing face. The plastic lining also protects the product space of the filling device, in front of and behind the sealing face, against accumulations of product and against soiling by the product. Because the plastic lining extends into the product space on both sides of the sealing face, it is not deformed when opening and closing the filling valve, if it forms part of the sealing face. As a result, the edge of the plastic lining towards the product space can be formed absolutely flush and without play. This effectively counteracts accumulations of product. Such a plastic lining can be configured with smooth transitions in a manner that is advantageous for flow, and in particular, to reduce or minimize swirling of the product in the region of the filling valve. The filling operation can thus take place in a more homogeneous manner, for example with reduced formation of foam or bubbles (for example in the case of beverages containing CO2). The plastic lining is easy to clean and, in some cases, protects other components of the filling device against soiling.

The apparatus disclosed herein avoids the slight deformation of the O-ring seal with each opening and closing operation. This avoids the tendency for product residues to accumulate between the O-ring and the edges of the O-ring groove over time. The apparatus does so by having the plastic lining extend on both sides of the sealing face beyond its deformation range on the sealing face.

In principle, it is possible, instead of having a plastic liner, to produce one of the valve elements entirely from the plastic or polymer material. But doing so could adversely the valve element's stability. In one advantageous embodiment of the invention, therefore, the plastic lining is applied to a hard carrier material of the valve element, for example to a metal.

The plastic lining may be designed in a stable form that can be handled independently, for example as a shaped body or as a sleeve. Or it may be applied as a coating to the carrier material of the valve element by known coating methods, such as dip coating, spraying, gluing, etc.

A variety of options are available for use as a carrier material for valve elements. One option is a metal, such as aluminum. Another option is a hard plastic, such as a fiber-reinforced plastic. Because of its stiffness, a hard plastic defines a suitably precise product volume upon actuation by the actuator.

Another advantage of this embodiment is that the plastic lining can easily be produced in any desired shaped. For example, it can easily be made in the form of a cylinder with different diameters at both ends. The plastic lining can thus be easily arranged on the carrier material of the valve element. Such a plastic lining can be held thereon in a replaceable manner. This means that a plastic lining, such as a cylinder or sleeve, can be replaced when needed. For example, it can be replace after a predefined number of opening and closing cycles. Or it can be replaced after a given duration of use.

The plastic lining is preferably formed by a fluorinated hydrocarbon. Examples of suitable materials include polyether ketone ("PEEK"), polyvinylidene fluoride ("PVDF"), and polytetrafluoroethylene ("PTFE"). Such polymers are both hydrophobic and easy to clean. As a result, products do not tend to adhere to the polymer. Fluorinated hydrocarbons thus promote hygiene.

In some embodiments, an elastomer forms the plastic lining. This promotes a certain extent of elastic flexibility and thus promotes a more leak-proof valve.

The plastic lining preferably surrounds at least most of, and preferably all of the product space in the region of a valve stem. In this way, the coverage region of the plastic lining is integrated into the wall of the product space. As a result, it becomes easy to clean the product space together with the sealing face.

In some embodiments, the other valve element that cooperates with the plastic lining of the one valve element has, at least in the region of the sealing face, a surface made of metal or thermosetting plastic. This means that the plastic lining of one valve element cooperates with a hard counterface of the other valve element in the region of the sealing face. This offers a high degree of leak tightness and also a defined deformation of the sealing faces and thus precise control of the filling quantity. In some embodiments, a plastic lining is on both valve elements. This increases the elastic properties of the filling valve in the region of the sealing face. However, it is possible to achieve a leak-proof fitting with a plastic lining on only one valve element.

In some embodiments, a valve stem forms one valve element and a valve housing forms the other valve element. Such a configuration forms a filling valve that has proven to be reliable in filling devices.

The valve stem has a region that is widened to form a droplet-shaped body. This region cooperates with a reduced-diameter region of the valve housing to form the sealing face. In this case, the valve housing or the valve stem may have the plastic lining. In some embodiments, the valve stem is widened in a droplet-shaped manner that, due to its favorable flow properties, leads to a low degree of swirling of the product in the region of the filling valve.

In some embodiments, the plastic lining is configured as a profiled plastic sleeve that covers the inner side of the valve housing. The valve stem in such cases preferably comprises a metal part, such as aluminum. In some embodiments, the profiled plastic sleeve surrounds the entire region of the filling valve and thus ensures a high degree of protection against soiling. The profiled plastic sleeve is easy to produce and can easily be arranged on the preferably cylindrical valve housing.

In some embodiments, the profiled plastic sleeves extends so far into the product space that the widened-diameter valve stem is completely surrounded by the plastic lining. This is because, in the widened-diameter region of the valve stem, the flow speed of the product often increases so that the valve housing is particularly susceptible to soiling in this region. By having the profiled plastic sleeve extend over the widened-diameter region of the valve stem, it is possible to more effectively avoid soiling the product space. Moreover, account can be taken of wear if the profiled plastic sleeve is arranged in a replaceable manner.

In some embodiments, the profiled plastic sleeve has, at one of its ends, a diameter corresponding to the diameter of the product space, and, at the other end, a diameter corresponding to the filling valve, which is generally smaller than the diameter of the product space. As already indicated above, the valve housing is generally of reduced diameter in the region of the sealing face. The profiled plastic sleeve made of polymer material can easily be produced in such a way that all the above necessary changes in diameter take place smoothly, without providing an edge in the plastic lining facing towards the product. The different diameter regions of the profiled plastic sleeve are thus connected to each other via round transition regions. This means that no product can become caught in the region of the profiled plastic sleeve itself, that is to say on the polymer surface. In mathematical terms, this means that the derivative of the surface profile of the profiled plastic sleeve is constant in a plane parallel to the axis of the filling valve.

According to the invention, no O-ring seal for the filling valve need be arranged in the region of the sealing face, since the sealing face can be formed solely by the plastic lining of one valve element in collaboration with a counter-face of the other valve element.

While in the above-described form of a filling valve, with a valve stem on the valve housing, the valve housing preferably has the plastic lining, alternatively, or in addition, the valve stem can also have the plastic lining.

In some embodiments, the profiled plastic sleeve extends into the product space by at least two centimeters, and preferably by at least three centimeters, in front of the sealing faces. In this way, the plastic lining surrounds the entire inflow region of the filling valve.

In another embodiment, the plastic lining, which is preferably in the form of a sleeve, projects into the opening of a container to be filled, for example a bottle. This provides protection against soiling of any part of the filling device behind the filling valve, and in particular, against splashing of the product during the filling operation. This embodiment thus promotes an extremely high standard of hygiene.

In some embodiments, the profiled plastic sleeve has a container-side end with lateral exit openings. This leads to a desired flow profile of the product filled into the container, which makes it possible to reduce the formation of foam or bubbles and thus to achieve quicker filling. This feature is particularly useful for carbonated beverages.

In some embodiments, the container-side end of the plastic sleeve has at least one flow-guiding face that ensures that the product flow is advantageously guided into the lateral exit openings. This, too, leads to a filling operation in which the flow has properties that promote quicker filling of liquids that are difficult to fill, such as wheat beer.

As used herein, "plastic" refers to all polymers and mixtures thereof, including rubbers.

The different embodiments described above can be combined with each other in any desired manner.

BRIEF DESCRIPTION OF THE DRAWINGS

The invention will be described below by way of example with reference to the schematic drawing.

DETAILED DESCRIPTION

Figure 1:
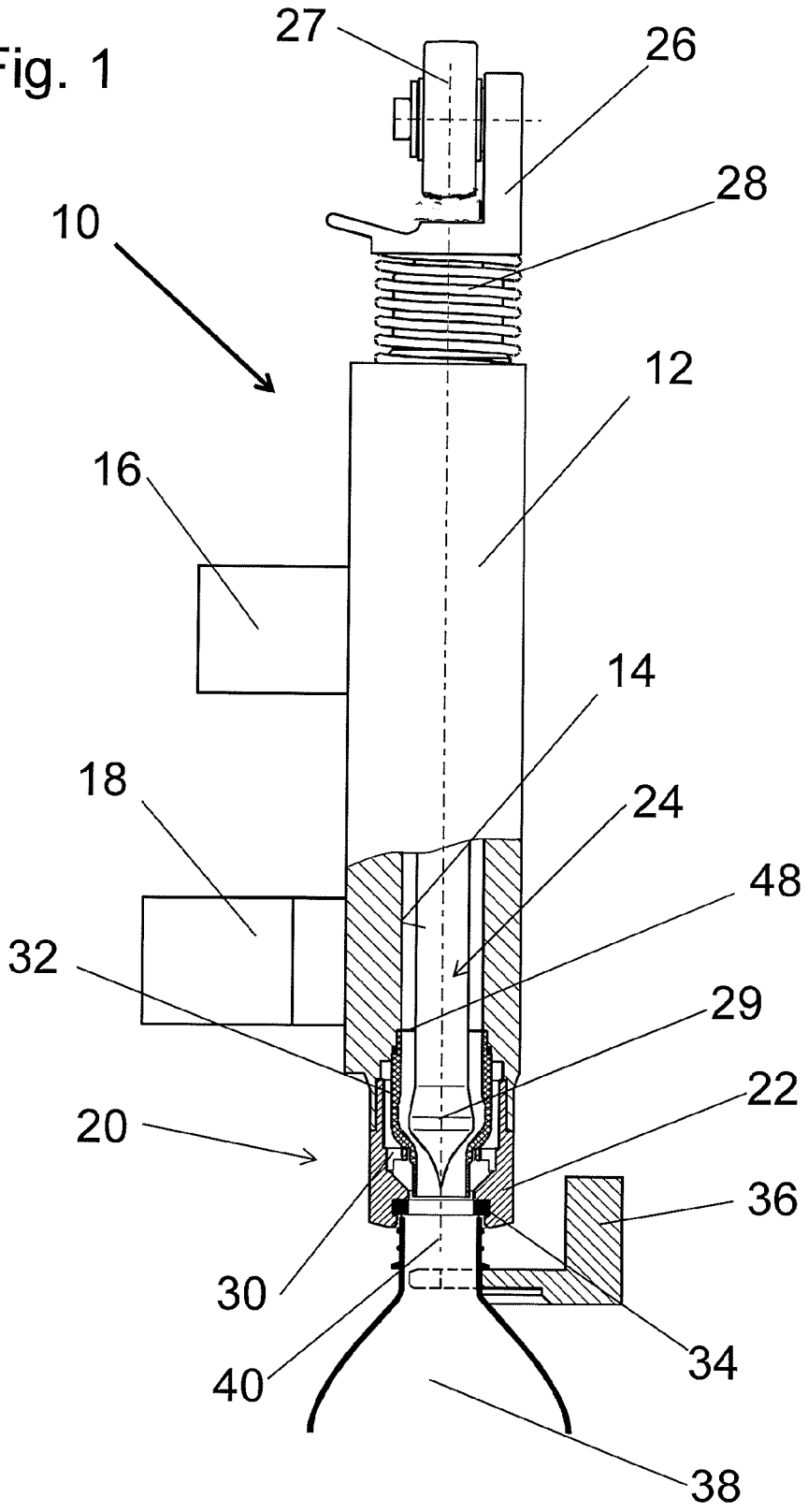
FIG. 1 shows a partially cut-away side view of a first embodiment of a filling device.
Figure 2:
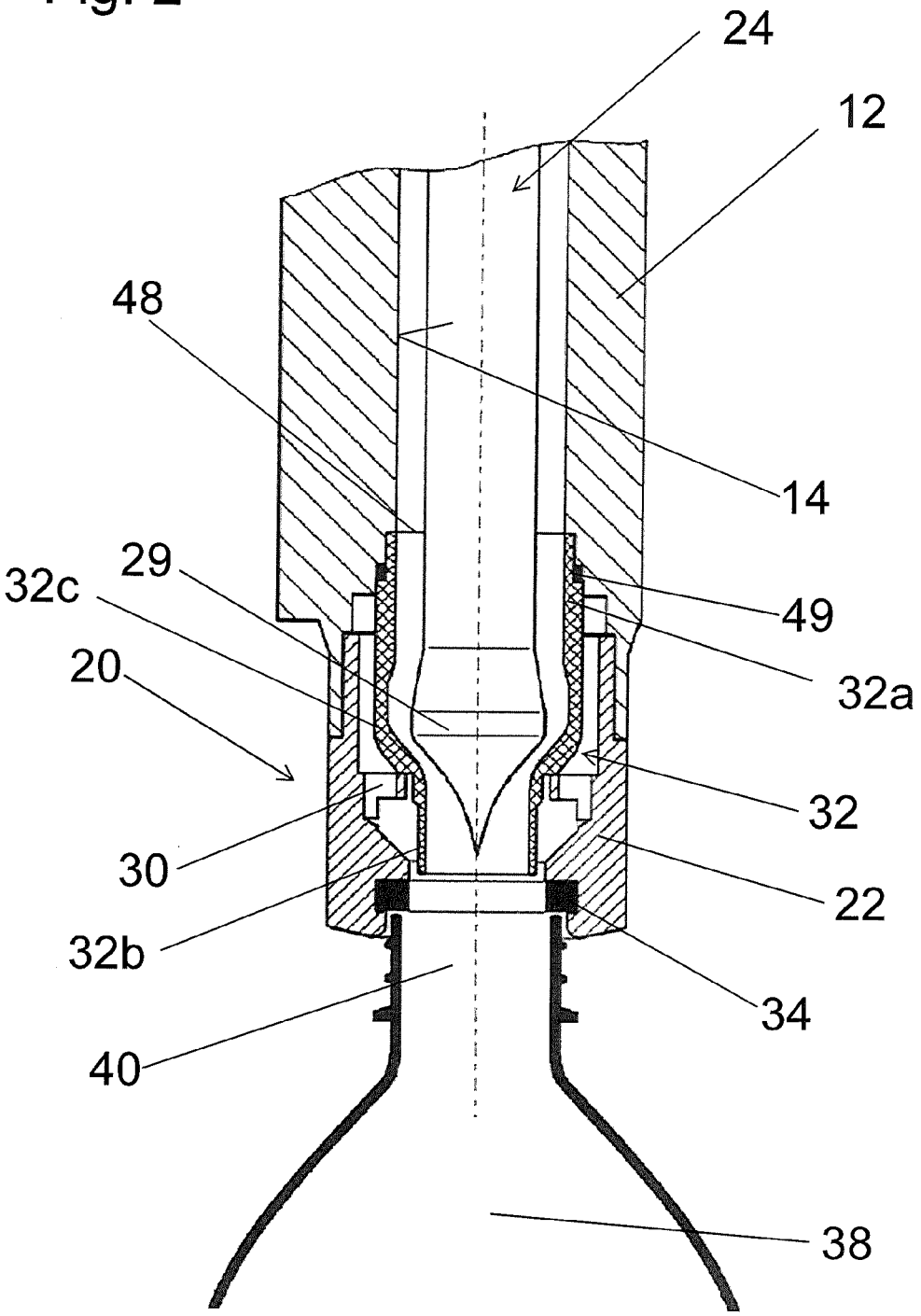
FIG. 2 shows an enlarged detail of the filling device of FIG. 1.

FIGS. 1 and 2 show a container 38 ready to be filled at a filling device 10. The filling device 10 has a cylindrical housing 12 that defines a cylindrical product space 14 in its interior. The filling device 10 also has a product feed 16 for feeding a product into the cylindrical product space 14, a holder 18, and a filling valve 20, which has a cylindrical valve housing 22 arranged at the lower end of the housing 22.

An actuating mechanism moves a plunger rod 24 along an axis of the product space 14. A plunger head 26 at the plunger rod's upper end bears a roller 27 that runs along a control cam of the filling device's actuating mechanism. At its lower end, the plunger rod 24 widens into a droplet-shaped valve stem 29.

A spring 28 biases the plunger head 26 axially against the housing 12 in such a way as to urge the roller 27 to bear against a control cam. As a result, the valve stem 29 cooperates with the valve housing 22 at the sealing face.

A reduced-diameter edge 30 of the valve housing 22 defines the region of the filling valve's sealing face. A profiled plastic sleeve 32 covers the entire region of the valve housing 22, from the cylindrical product space 14 at the lower end of the housing 12 to the filling region of the filling device 10. The profiled plastic sleeve 32 runs over the reduced-diameter edge 30 of the valve housing 22 and cooperates there with the droplet-shaped widening of the valve stem 29 to form a sealing face.

The roller 27 actuates the filling valve's valve stem 29, thus causing it to transition between closed and open positions. In all the figures, the open position of the filling valve 20 is shown.

In the closed position, a control cam deflects the roller 27 downwards, counter to the force of the spring 28. As a result, the valve stem 29 bears against the profiled plastic sleeve 32 in the region of the reduced-diameter edge 30.

At its lower end, the valve housing 22 has an O-ring seal 34. During filling, a container holder 36 holds the container 38 so that it bears with its mouth 40 against the O-ring seal 34.

The profiled plastic sleeve 32 extends to just above the O-ring seal 34. As a result, the profiled plastic sleeve 32 reliably protects the filling valve 20 against soiling by the product during the filling operation.

Referring now to FIG. 2, the profiled plastic sleeve 32 has a first region 32*a* and a second region 32*b*, the diameter of which is less than that of the first region 32*a*. The first region 32*a* adjoins the product space in a flush manner. The second region 32*b* forms a filling outlet through which filling material flows into the container 38. Between the first and second regions 32*a*, 32*b* is a transition region 32*c* that provides a smooth and step-free transition between the diameters of the first and second regions 32*a*, 32*b*. The valve stem 29 is arranged in the transition region 32*c*.

Figure 3:
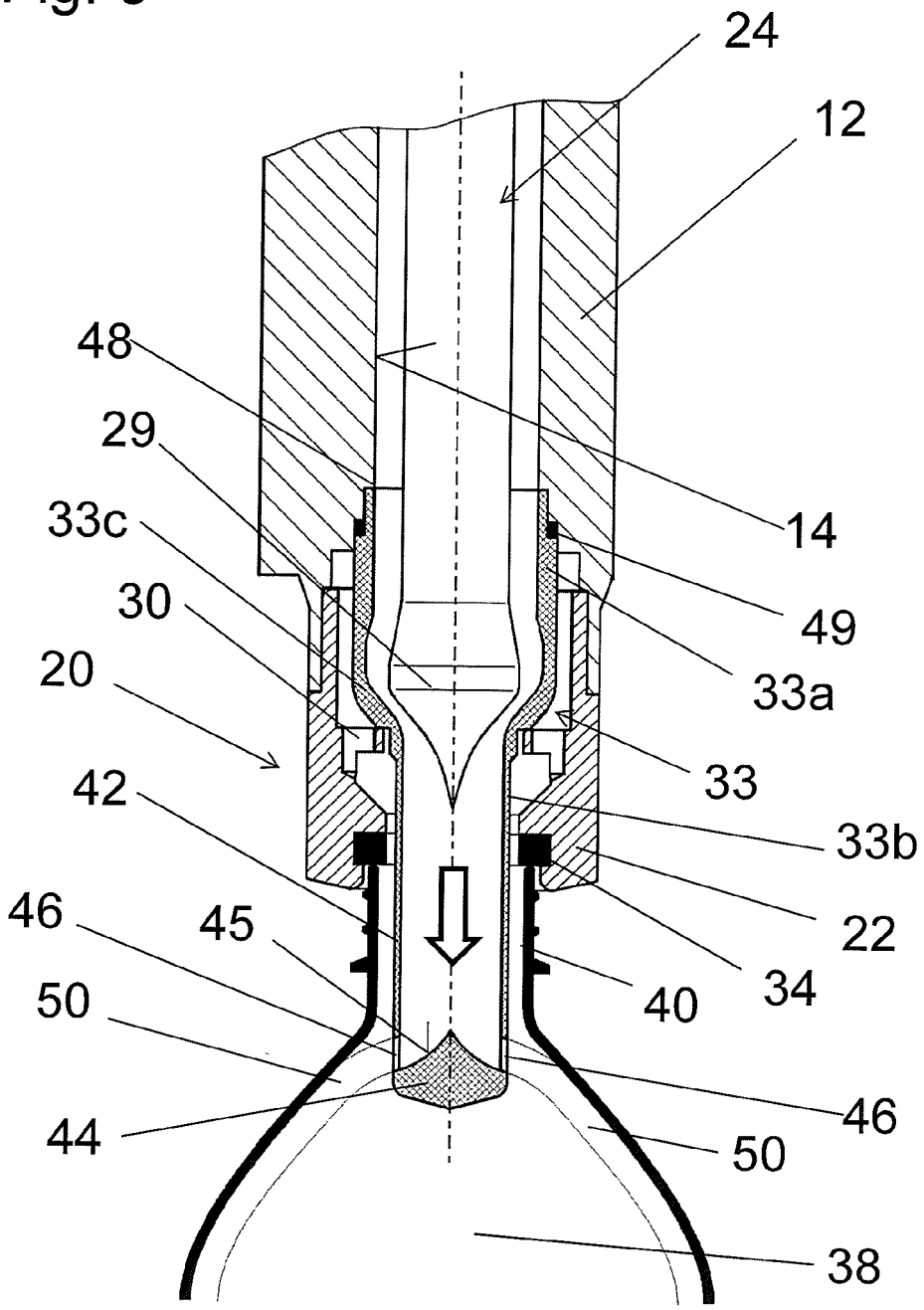
FIG. 3 shows a view according to FIG. 2 of a second embodiment of a profiled plastic sleeve that projects into the opening of a container to be filled.

FIG. 3 shows a second embodiment of an extended profiled plastic sleeve 33 that is substantially identical to the profiled plastic sleeve 32 of FIGS. 1 and 2. The main difference is that the extended profiled plastic sleeve 33 has, at its lower end, a cylindrical sleeve part 42 that extends through the container's mouth 40 and into the container 38.

An end wall 44 at the lower end of the cylindrical sleeve part 42 includes a flow-guiding face 45. The flow-guiding face 45 slopes outwards and downwards from the center of the sleeve 33 to lateral exit openings. As a result, liquid filling product exits from the profiled plastic sleeve 33 and out through the lateral exit openings 46 without swirling. This permits the liquid filling product to enter the container 38 in an entry flow 50 along the container wall in a way that avoids pronounced bubble or foam formation occurring in the container 38 during the filling operation. Some embodiments omit the end wall 44. However, in these embodiments, there is essentially no protection against splashing.

The extended profiled plastic sleeve 33 has a first region 32*a* and a second region 32*b*, the diameter of which is less than that of the first region 32*a*. The first region 32*a* adjoins the product space in a flush manner. The second region 32*b* forms a filling outlet through which filling material flows into the container 38. Between the first and second regions 32*a*, 32*b* is a transition region 32*c* that provides a smooth and step-free transition between the diameters of the first and second regions 32*a*, 32*b*. The valve stem 29 is arranged in the transition region 32*c*.

As can be seen, in particular from FIGS. 2 and 3, the profiled plastic sleeve 32 and also the extended profiled plastic sleeve 33 offer very good protection against soiling of the filling device in the region upstream and downstream of the filling valve.

The plastic lining, which in the illustrated embodiment is a profiled plastic sleeve 32, 33, is made of any of a number of plastic materials. In some cases, the plastic lining is made of an elastomer. In other cases, it is made of a fluorinated hydrocarbon. Additional materials that can be used to make a plastic lining include PEEK, PVDF, and PTFE.

An upper edge 48 positions the profiled plastic sleeve 32, 33 on the product space 14. This upper edge 48 can be machined with great precision. Opening and closing of the valve therefore does not deform this plastic lining. This means that the transition the transition from the product space 14 to the profiled plastic sleeve 32 and 33 is insensitive to soiling.

Moreover, due to the use of a stepped seal arrangement 49 with an O-ring seal on the upper edge 48 of the profiled plastic sleeve 32, 33, it is possible to ensure 100% leak tightness. The region of the valve housing 22, which is covered by the profiled plastic sleeve, is thus reliably protected against soiling by the product. As a result, the apparatus described herein promotes a high standard of hygiene for filling devices.

In some embodiments, the plastic sleeve is configured at its lower end in such a way that it functions as a gas lock. This permits drip-free filling.

Certain gas locks cause swirling of the outflowing filling product. This means that the filling product bears against the container wall as it flows into the container.

Having described the invention, and a preferred embodiment thereof, what is claimed as new, and secured by Letters Patent is:

1. An apparatus for filling containers with liquid-containing product, said apparatus comprising a filling device, said filling device comprising a filling valve comprising first and second valve-elements disposed in a region thereof, said first and second valve-elements bearing against each other at a sealing face when said filling valve is in a closed position and being spaced apart from each other when said filling valve is in an open position, said first valve-element comprising a valve stem and said second valve-element comprising a valve housing having a reduced-diameter edge, an actuator that causes said first and second valve elements to move relative to each other, and a plastic lining that faces a product space that ends in said filling valve, wherein plastic lining comprises a profiled plastic sleeve that runs over said reduced-diameter edge, wherein said plastic lining forms a portion of said sealing face of said second valve element, and wherein said first valve-element comprises, in a region of said sealing face, a material selected from the group consisting of metal and plastic.

2. The apparatus of claim 1, further comprising a profile part applied to a hard carrier material of said second valve element, wherein said profile part forms said plastic lining.

3. The apparatus of claim 2, wherein said profile part is held on said second valve element in a manner that makes said profile part replaceable.

4. The apparatus of claim 2, wherein said hard carrier material comprises metal.

5. The apparatus of claim 2, wherein said hard carrier material comprises thermosetting plastic.

6. The apparatus of claim 1, wherein said plastic lining surrounds a portion of said product space in front of said sealing face.

7. The apparatus of claim 1, wherein said plastic lining comprises a recess for an O-ring seal for forming a portion of said sealing face.

8. The apparatus of claim 1, wherein said plastic lining comprises a profiled plastic sleeve that covers an entire inner side of said valve housing.

9. The apparatus of claim 1, wherein said profiled plastic sleeve surrounds said valve stem and is separated from said valve stem by a portion of said product space.

10. The apparatus of claim 1, further comprising a transition region, wherein said profiled plastic sleeve comprises first and second ends having corresponding first and second diameters, wherein said first diameter corresponds to said product space, wherein said second diameter corresponds to said filling valve, wherein said transition region extends between said first and second diameters, and wherein said transition region is circular in cross-section and edge free.

11. The apparatus of claim 1, wherein said profiled plastic sleeve projects into an opening of a container that is to be filled.

12. The apparatus of claim 1, wherein said profiled plastic sleeve comprise an end wall on a container side thereof and lateral exit openings in said end wall.

13. The apparatus of claim 12, wherein said end wall comprises a flow-guiding face.

14. The apparatus of claim 1, wherein said valve stem is a centric valve stem, and wherein said plastic lining faces said centric valve stem across a portion of said product space.

15. The apparatus of claim 1, further comprising an upper edge that positions said profiled plastic sleeve on said product space such that opening and closing said valve does not deform said plastic lining.

16. The apparatus of claim 1, wherein said profiled plastic sleeve forms a gas lock at a lower end thereof.

17. The apparatus of claim 1, wherein said actuator comprises a roller and a spring, wherein said roller is configured to be deflected to counter a force of said spring such that said valve stem bears against said profiled plastic sleeve.

18. The apparatus of claim 1, wherein said valve stem comprises a droplet-shaped widening that cooperates with said profiled plastic sleeve to form a sealing face.

19. The apparatus of claim 1, wherein, as a result of said plastic lining having run over said reduced-diameter edge, said reduced-diameter edge and said plastic lining are in contact and cooperate to form said sealing face.

* * * * *